US005375524A

United States Patent [19]

Larson

[11] Patent Number: 5,375,524

[45] Date of Patent: Dec. 27, 1994

[54] BLASTING CONNECTOR SYSTEM AND METHOD OF USE

[76] Inventor: Larry J. Larson, 3273 Cardinal Dr., Sharpsville, Pa. 16150

[21] Appl. No.: 152,359

[22] Filed: Nov. 16, 1993

[51] Int. Cl.[5] ..... F42C 11/00

[52] U.S. Cl. ..... 102/217

[58] Field of Search ..... 102/217, 206, 200, 202.9; 361/248, 249

[56] References Cited

U.S. PATENT DOCUMENTS

| | | | |
|---|---|---|---|
| 3,675,578 | 7/1972 | Douglas et al. | 102/70.2 |
| 4,103,619 | 8/1978 | Fletcher et al. | 102/28 R |
| 4,271,453 | 6/1981 | Yajima et al. | 361/248 |
| 4,369,707 | 1/1983 | Buddle | 102/202.2 |
| 4,796,531 | 1/1989 | Smithies et al. | 102/217 |
| 4,825,765 | 5/1989 | Ochi et al. | 102/217 |
| 5,054,395 | 10/1991 | Vetter et al. | 102/202.3 |

*Primary Examiner*—Daniel T. Pihulic

*Attorney, Agent, or Firm*—Henderson & Sturm

[57] ABSTRACT

A Blasting Connector System (10) for use in a conventional blasting environment, wherein the system comprises a plurality of structurally similar and compatible components which include a Cap Connector (20), a Male Jumper (30), a Female Jumper (40), a Series Connecting Cable (50), a Parallel Connecting Cable (60), a Cap Connector Assembly (70) and a Test Connector (80) which are incorporated in various combinations and sequences to form a blasting circuit between the explosive charges (100) and a blasting machine (110).

10 Claims, 7 Drawing Sheets

BLASTING CONNECTOR SYSTEM AND METHOD OF USE

TECHNICAL FIELD

The present invention relates to the field of explosive detonation systems in general, and, in particular, to a new type of connector/wiring system for use in a blasting environment, and its method of use.

BACKGROUND ART

As can be seen by reference to the following U.S. Pat. Nos. 3,675,578; 4,369,707; 4,103,61 9; and 5,054,395; the prior art is replete with myriad and diverse cooperating male and female connectors for use in blasting systems as well as methods for testing blasting circuits.

While all of the aforementioned prior art constructions are adequate for the basic purpose and function for which they have been specifically designed, these patented arrangements have not provided a means for the methodical and uniform wiring and interconnection of electrical circuits used in large scale commercial blasting, in a manner that is highly convenient, reliable, comprehensive and safe, nor which in any way supplants the conventional manual wiring techniques which have been in use for decades. The provision of such a construction is a stated objective of the present invention.

BACKGROUND of the INVENTION

The invention in question is basically a plurality of connectors, connector/cable assemblies and their method of use which greatly facilitates and makes safer the utilization of electric blasting caps in the various and diverse types of blasting environments which exist today.

While these connectors and connector/cable assemblies, in and of themselves, are quite simple, their purpose and utility may not be readily apparent to someone not knowledgeable about blasting. Therefore, before more fully expounding upon this invention, a few facts about blasting with electric blasting caps shall be presented herewith.

A "detonator" is an explosive device that is used to cause the "detonation" or "initiation" of another explosive material, such as dynamite, a "cast booster", "detonating cord" or other "cap sensitive secondary explosive" when placed inside of, or juxtaposed to, such explosive, whereupon such explosive charge is said to be "primed". An "electric blasting cap" or "cap" is a detonator that is caused to function (detonate) by use of an electric current passed through the "leg wires" of the cap. In an electrical circuit designed for their "firing", electric blasting caps essentially function as resistors; and, therefore, electrically can be considered resistors. This fact is fundamental to the wiring of firing circuits.

A machine called a "blasting machine" generally provides the electrical energy needed for the firing of electric blasting caps. This machine is an electronic device which is capable of providing current for the firing of from one to hundreds of caps. Of course, in order for the electrical energy to be delivered to the electric blasting caps, a properly designed and integrated wiring circuit of the caps must be created. There are several types of such circuits.

A "series circuit" is an electrical circuit in which electric blasting caps (resistors) are wired in a daisy chain fashion. A "parallel circuit" is an electrical circuit in which the caps are wired so that each leg wire is connected to one of two separate common points. A so called "parallel-series" circuit is one in which groups of caps are wired in series ("series of caps"), and these series are, in turn, wired in parallel. These circuits are illustrated in FIG. 1.

In blasts where only a few (i.e., less than fifty) caps are used, a simple series circuit is often employed. However, relatively simple electrical circuit analysis shows that in blasts where many caps are used, in order to reliably assure the detonation of all caps, the type of circuit that should generally be used is the parallel-series circuit as shown in FIG. 1. This parallel-series circuit, properly wired, is the most efficient means of distributing the electrical energy from the blasting machine to the individual caps and is the type of circuit virtually always used in large blasts in which electric blasting caps are used.

The primary purpose of this invention is to greatly expedite the wiring of such series only and parallel-series circuits. In order to demonstrate the considerable advantages over conventional techniques that use of this invention affords, a typical quarry blasting scenario employing a parallel-series circuit of electric blasting caps will be described, first by using such conventional techniques, and further on in this specification, the same scenario will likewise be described making use of this invention. The description utilizing these conventional techniques immediately follows.

Usually, a quarry blast involves the drilling of a pattern or matrix of holes in the rock face to be blasted, generally in a series of rows, each containing a number of holes. After each hole is loaded with explosives and primed, the electric blasting cap embedded in the "priming cartridge" or "primer" should be tested using a device called a "blasters' galvanometer". This is an electronic device which essentially measures circuit resistance using a controlled amount of current, an amount far below that necessary to "fire" the cap. In order to do this, the electric blasting cap's "shunt" (e.g., a shorting device which is placed across the cap's leg wires preventing its unintended detonation, and something with which all caps are provided) must be removed and its bare leg wires must be touched to the galvanometer's terminals. Readings of the exact resistance can be made, but generally what is important at this point is whether the circuit is "shorted", that is, having zero resistance, or "open", that is, having "infinite" resistance. If the circuit is open or shorted, a problem is indicated. Usually, if this happens, a new primer must be placed in the hole. After the cap has successfully passed this verification procedure, the cap shunt is replaced and the hole is "stemmed" (e.g., inert material is loaded on top of the explosive column to provide confinement for the blast) and the blaster proceeds to the next hole. The process is repeated until all holes have been loaded, primed and stemmed.

Since, in this example a parallel-series method of hookup is to be employed, the blaster lays out the "bus wires". This is the portion of the circuit which will connect in parallel the various series of electric blasting caps. The bus wire circuit must be kept "shunted".

The blaster then proceeds to hookup each series of caps. This he does by starting with the first cap in the first series. After having their respective shunts removed, one of the leg wires of the first cap is wired to one of the bus wires and the other is wired to the one of the leg wires of the next cap in the series. This may be done by placing the bare wires next to each other, bending the bare areas of each wire approximately in half and twisting them together and then tying the mated wires in a knot for strain relief. (If the leg wires of the respective caps are not long enough to be connected directly, the blaster must splice a wire between them, thus requiring an additional junction.) Sometimes, in order to prevent the invasion of the circuit by ground currents or the possibility of a short circuit caused by the conductivity of the wet earth, this uninsulated junction is placed on a rock or is suspended above the ground on a stick. All to often, however, it is just cast on the ground, potentially a very dangerous practice. This process is continued by wiring the second leg wire of the second cap to the first leg wire of the third cap in the series, and so forth. Finally, the second leg wire of the last cap in the series is wired to the other bus wire. The series is then complete. Note that until the last cap has been wired, the caps, as progressively wired in the series, are left essentially "unshunted".

Once all series have been wired to the bus wires, the bus wires are hooked to the connecting wires and the connecting wires to the "firing line". Finally, all circuit shunts are removed and the completed circuit is tested with the galvanometer. If the circuit passes this verification, the firing line is attached to the blasting machine and the blast is fired.

As can be seen from the description just given, the wiring of blasting circuits using conventional techniques can be tedious, time consuming, require considerable care to avoid errors which might result in "misfires", and even be dangerous, The purpose, then, of this invention is to provide a connector/wiring system for the wiring of blasting circuits involving electric blasting caps, which, while being comprehensive and safe, will vastly simplify the procedures hereinabove described. Achievement of this objective by this invention will be demonstrated in this specification.

In order to best present this invention and demonstrate its utility, the disclosure of the invention is divided into several parts, namely, a "Brief Description of the Drawings", a "Description of Components" and the "Best Mode for Utilizing the Invention". When the textual description is reviewed in conjunction with the attendant drawings, the substance and salient attributes of the invention will become clear.

BRIEF DESCRIPTION OF THE DRAWINGS

The following is a description of the drawings which serve to elucidate the textual description provided hereinunder.

DESCRIPTION OF THE COMPONENTS

Figure 12:
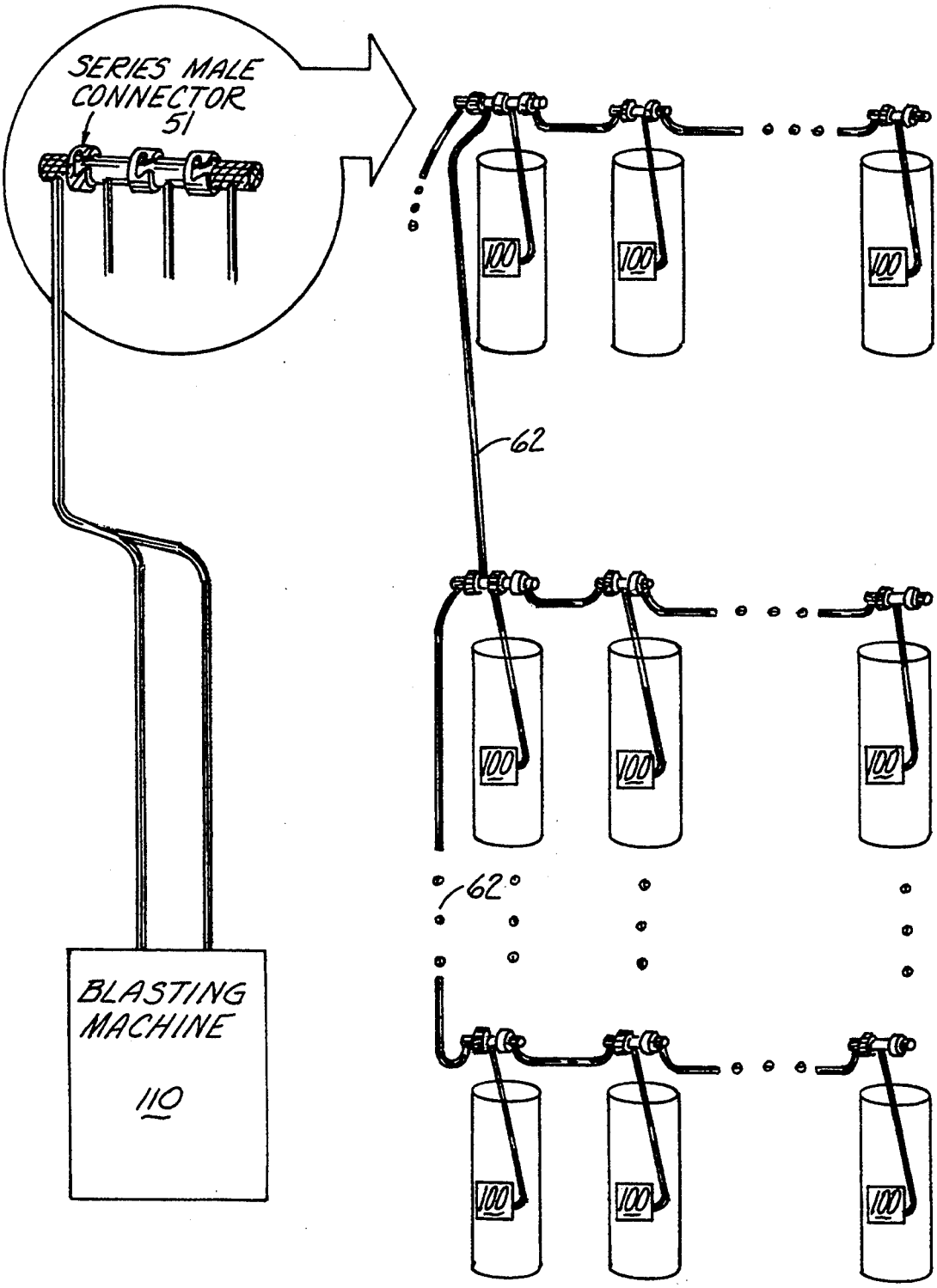

As can be seen by reference to the drawings, and in particular to FIG. 12, the "Blasting Connector System" (10) is comprised of a plurality of connectors and connector/cable assemblies that interconnect with one another to operatively integrate a collection of individual explosive charges (100) into either a blasting circuit and/or a pre-blast test circuit, as will be explained in greater detail hereinunder in this specification.

The Blasting Connector System (10) includes a "Cap Connector" (20), a "Male Jumper" (30), a "Female Jumper" (40), a "Series Connecting Cable" (50), a "Parallel Connecting Cable" (60), a "Cap Connector Assembly" (70) and a "Test Connector" (80). These structural components will now be described in seriatim fashion.

Figure 1:
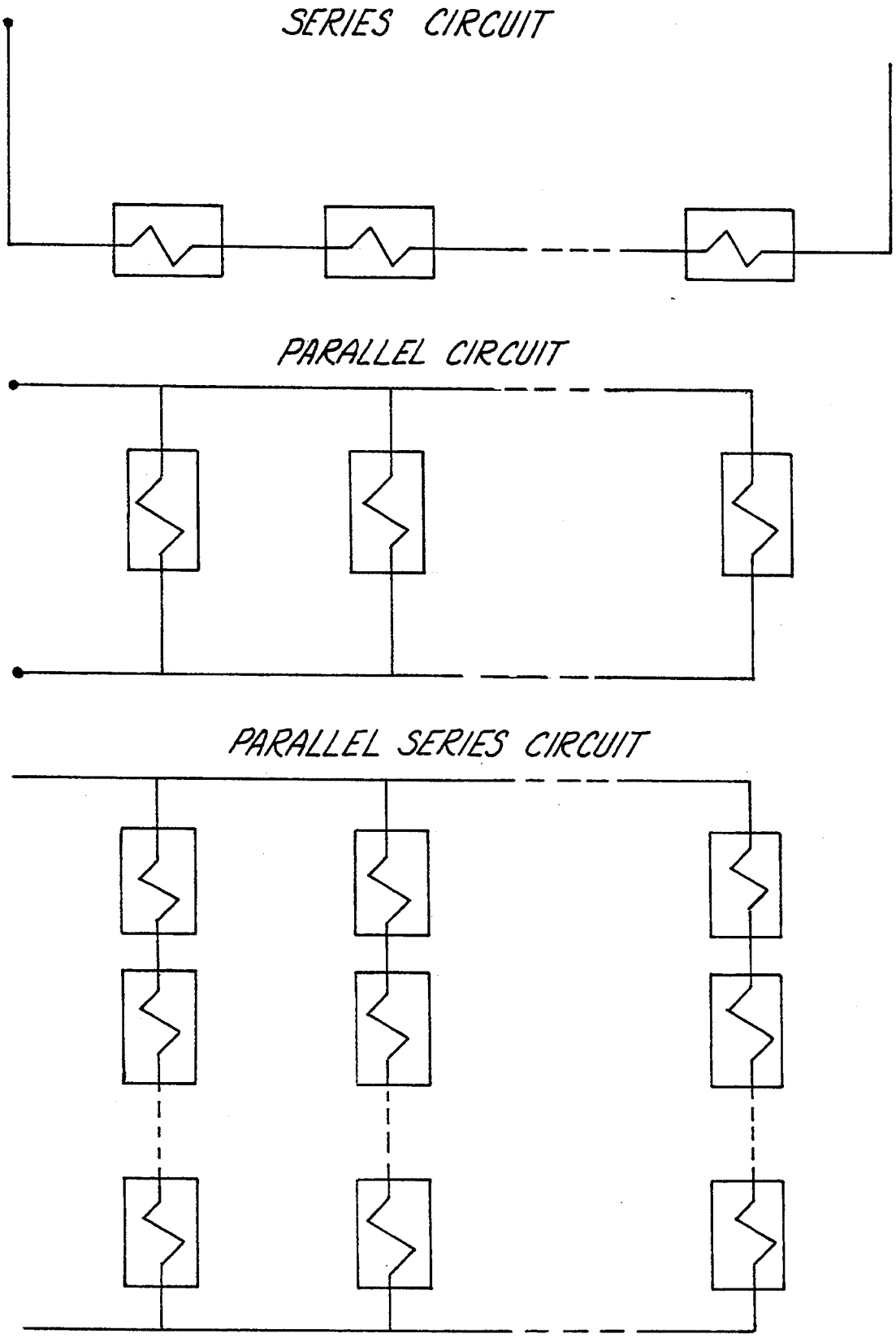
Fig. 1 is a wiring diagram depicting typical circuits employed in the firing of electric blasting caps.
Figure 2:
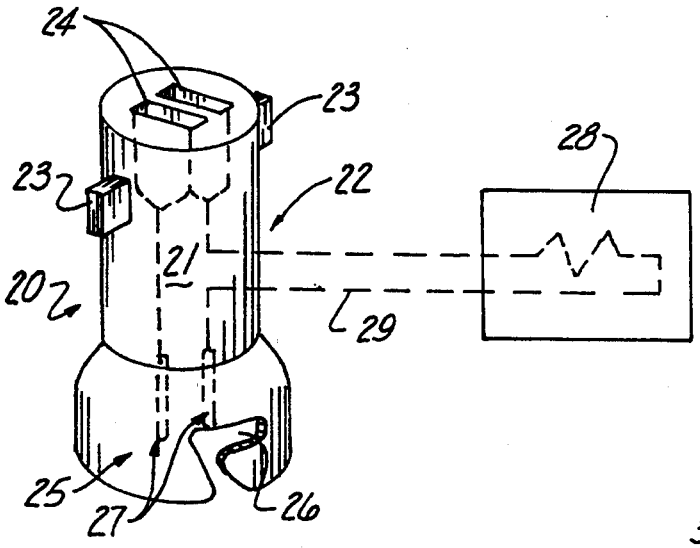
FIG. 2 is a perspective diagram of a "Cap Connector" operatively associated with an electric blasting cap.

Cap Connector. As shown in FIG. 2, the Cap Connector (20) is comprised of a cap connector body (21), having an elongated, generally cylindrical upper female portion (22) which is provided with a pair of outwardly projecting opposed ears (23) disposed on the side of the female portion (22) and a pair of female electrical contact sockets (24) formed in the end of the female portion (22) proximate to the ears (23), and having a lower male portion which is provided with a hollow skirt (25) having a pair of opposed J-shaped slot apertures (26) and a pair of male electrical contact pins (27) that extend from the interior of the cap connector body (21) into the hollow skirt (25). An electric blasting cap (28) is mechanically coupled to the cap connector body (21) via its leg wires (29) which are electrically terminated in the female portion (22) by one pin (27) and one socket (25). The other pin (27) and socket (25) are connected to each other as shown.

Figure 3:
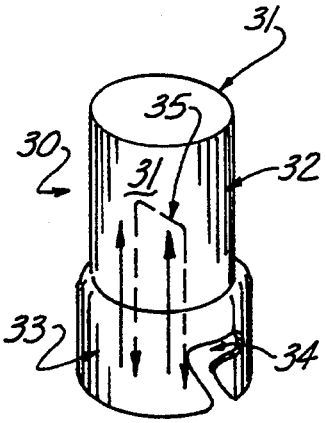
FIG. 3 is a perspective diagram of a "Male Jumper"

Male Jumper. As shown in FIG. 3, the Male Jumper (30) is comprised of a male jumper body (31) having a relatively short, generally cylindrical upper portion (32) which terminates in a lower portion which is provided with a hollow skirt (33) having a pair of opposed J-shaped slot apertures (34) and a pair of male electrical contact pins (35) which are electrically connected to one another within the male jumper body (31) and which extend into the hollow skirt (33).

Figure 4:
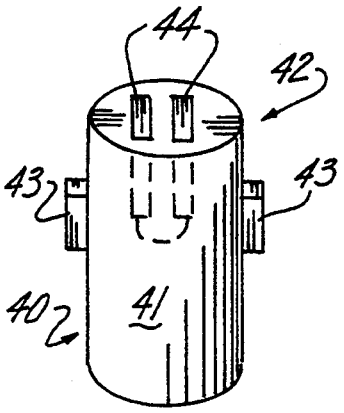
FIG. 4 is a perspective diagram of a "Female Jumper"

Female Jumper: Turning now to FIG. 4, it can be seen that the Female Jumper (40) is comprised of a relatively short, generally cylindrical female jumper body (41) whose upper portion (42) is provided with a pair of outwardly projecting ears (43) disposed on the outside surface of its upper portion (42) and a pair of electrically connected female electrical contact sockets (44) formed in the end of the upper portion (42) proximate to the ears (43).

Figure 5:
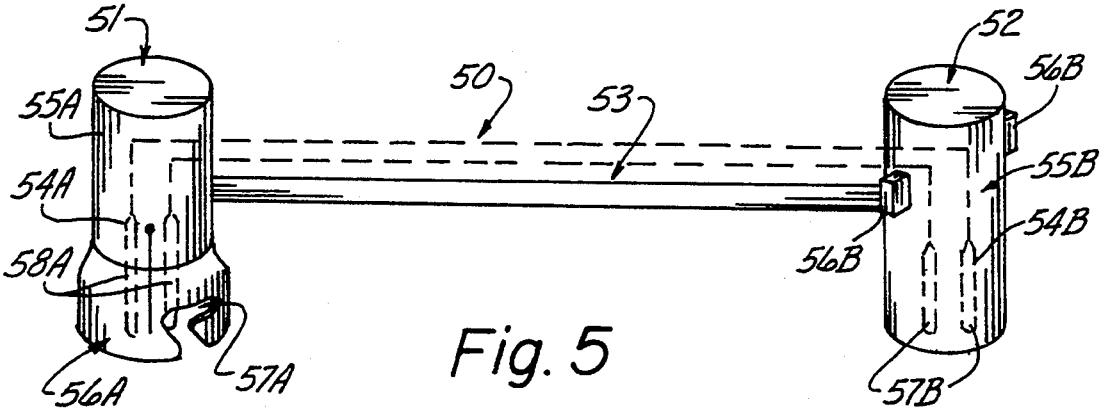
FIG. 5 is a perspective diagram of a "Series Connecting Cable"

Series Connecting Cable. As can be seen by reference to FIG. 5, the Series Connecting Cable (50) is comprised of a Series Male Connector (51), a Series Female Connector (52) and a length of duplex wiring cable (53), wherein the Series Male Connector (51) is comprised of a male connector body (54A) having a relatively short, generally cylindrical upper portion (55A) which terminates in lower portion which is provided with a hollow skirt (56A) having a pair of opposed J-shaped slot apertures (57A) and a pair of male electrical contact pins (58A) which extend into the hollow skirt (56A) and which are electrically connected to a length of duplex electrical wiring (53); and, wherein the Series Female Connector (52) is comprised of a relatively short, generally cylindrical female connector body (54B) whose upper portion (55B) is provided with a pair of outwardly projecting ears (56B) disposed on the outside surface of its upper portion (55B) and a pair of female electrical contact sockets (57B) formed in the end of the upper portion (55B) proximate to the ears (56B) and which are electrically connected to a length of duplex wiring (53); and, wherein the male electrical contact pins (58A) of the Series Male Connector (51) and the female electrical contact sockets (57B) of the Series Female Connector (52) are electrically connected to each other by the duplex wiring cable (53) as shown. Note that Series Connecting Cables (50) of various lengths will be utilized in this system.

Figure 6:
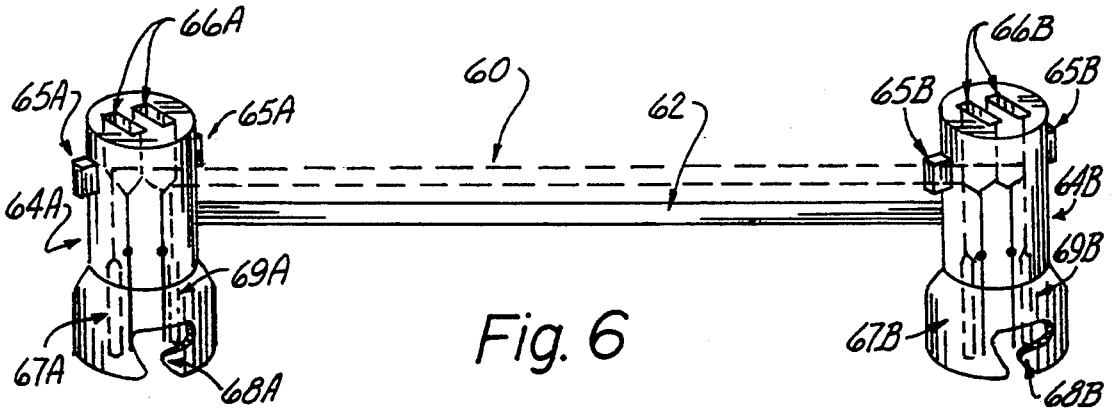
FIG. 6 is a perspective diagram of a "Parallel Connecting Cable"

Parallel Connecting Cable. As shown in FIG. 6, the Parallel Connecting Cable (60) is comprised of a pair of Parallel Connectors (61A, 61B) and a length of duplex wiring cable (62), wherein each Parallel Connector (61 A, 61 B) is comprised of a parallel connector body (63A, 63B) having an elongated, generally cylindrical upper female portion (64A, 64B) which is provided with a pair of outwardly projecting opposed ears (65A, 65B) disposed on the side of the female portion (64A, 64B) and a pair of female electrical contact sockets (66A, 66B) formed in the end of the female portion (64A. 64B) proximate to the ears (65A, 65B), and a lower male portion which is provided with a hollow skirt (67A, 67B) having a pair of opposed J-shaped slot apertures (68A, 68B) and a pair of male electrical contact pins (69A, 69B) that extend from the interior of the parallel connector body (63A. 63B) into the hollow skirt (67A, 67B), each electrically connected, respectively, to the female electrical contact sockets (66A, 66B); and, wherein the male electrical contact pins (69A, 69B) and the female electrical contact sockets (66A, 66B) of each Parallel Connector (61A, 61B) are electrically connected to each other by the duplex wiring cable (62) as shown. Note that Parallel Connecting Cables (60) of various lengths will be utilized in this system.

As should be inferred from their diagrams and descriptions, these components are designed to be mechanically and electrically interconnective (i.e., can be mated with each other): the inside diameter of the hollow skirt situated in the male or lower portion of the cap connector body (21), the male jumper body (31) the series male connector body (54A) and the parallel connector body (63) are dimensioned to receive the female or upper portion of the cap connector body (21), the female jumper body (41), the series female connector body (54B) or the parallel connector body (63); the J-shaped slot apertures of the cap connector body (21), the male jumper body (31) the series male connector body (54A) and the parallel connector body (63) are dimensioned to receive the ears of the cap connector body (21), the female jumper body (41), the series female connector body (54B) and the parallel connector body (63); and, the male electrical contact pins of the Cap Connector (20), the Male Jumper (30), the Series Male Connector (51) and the Parallel Connector (61) are dimensioned to be received by the female electrical contact sockets of the Cap Connector (20), the Female Jumper (40), the Series Female Connector (52) or the Parallel Connector (61). (Note that not all such possible mating combinations are used in this system.)

In order to accomplish this mechanical and electrical union, the interconnecting members must be brought into proximity to one another in the manifest manner and then mated with a slight "twisting" action. The two members will then be firmly mechanically and electrically interlocked and can only be separated, or "unmated", with deliberation by reversing the action taken during their union.

Since the features of the components in this system which provide for the mechanical and electrical interconnection capability are common, and for convenience of notation, such features shall be collectively assigned a descriptive name: the hollow skirt, J-shaped slot apertures and the male electrical contact pins of the Cap Connector (20), the Male Jumper (30), the Series Male Connector (51) and the Parallel Connector (61) shall hereinafter be referred to as the "Male Mating Interface" or "MMI"; similarly, the female or upper portion, the ears and the female electrical contact sockets of the Cap Connector (20), the Female Jumper (40), the Series Female Connector (52) and the Parallel Connector (61) shall hereinafter be referred to as the "Female Mating Interface" or "FMI".

Note that the "hermaphroditic" connectors, the Cap Connector (20) and the Parallel Connector (61), can be "stacked" (multiply mated) with themselves or each other. For example, a Cap Connector (20) can be mated with another Cap Connector (20), which can be mated to still a third and so forth. This stacking maintains the desired mode of wiring: stacking Cap Connectors (20) assures the wiring in series of the attached electric blasting caps (28); stacking of Parallel Connectors (61) assures parallel connection of each element or circuit to which such connector is attached. The usefulness of this capability will be illustrated hereinbelow.

Figure 7:
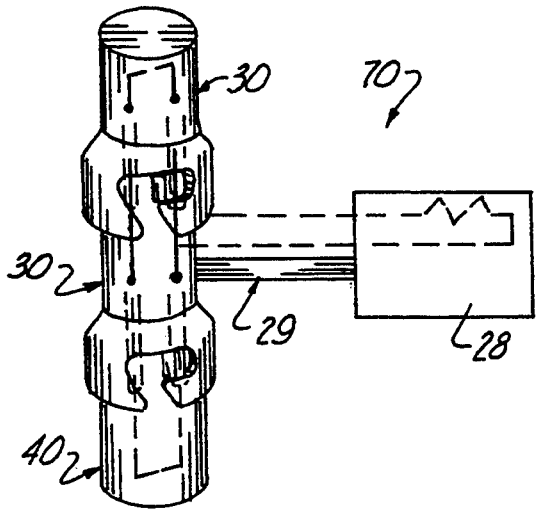
FIG. 7 is a perspective diagram of a "Cap Connector Assembly" operatively associated with an electrical blasting cap.

Cap Connector Assembly. As shown in FIG. 7, the Cap Connector Assembly (70) is comprised of a Cap Connector (20) unto which an electric blasting cap (28) is operatively attached as hereinabove described and into which a Male Jumper (30) and Female Jumper (40) have been inserted so as to effect mating. This illustrates one aspect of the mechanical and electrical interconnectability provided by these connectors. In the use of this system, it is assumed that electric blasting caps (28) shall be provided to the user with Cap Connector Assemblies (70) installed. Note that this Cap Connector Assembly (70) provides the requisite "shunting" of the electric blasting cap (28).

Figure 8:
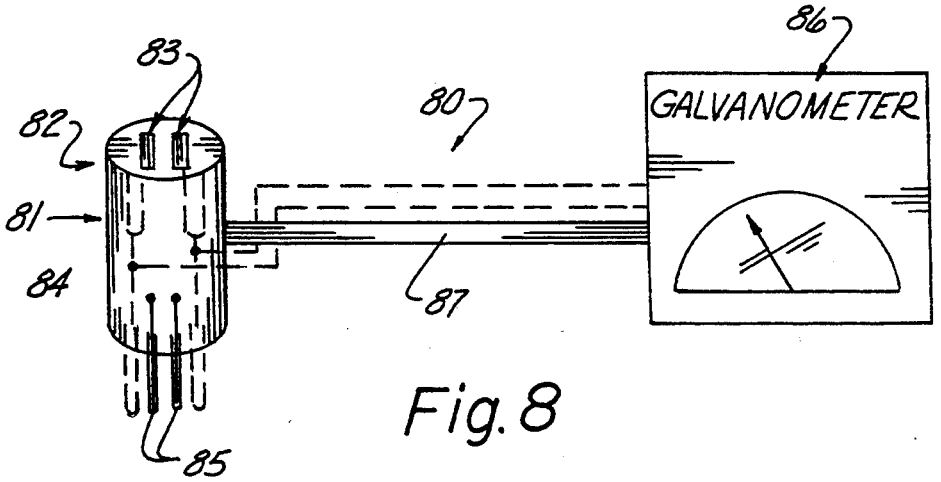
FIG. 8 is a perspective diagram of a "Test Connector"

Test Connector. Turning now to FIGS. 6 and 8, it can be seen and should be understood that the Test Connector (80) is quite similar in construction to the Parallel Connector (61). The Test Connector (80) is comprised of a test connector body (81) having an elongated, generally cylindrical upper female end (82) formed in the end of which is a pair of female electrical contact sockets (83), and a lower male end (84) from which protrudes a pair of male electrical contact pins (85) that extend from the interior of the test connector body (81), each electrically connected, respectively, to the female electrical contact sockets (83); and, wherein the male electrical contact pins (85) and the female electrical contact sockets (83) of the Test Connector (80) are electrically connected to a galvanometer (86)

by a length of duplex wiring cable (87) as shown. Naturally, the female end (82) and the male end (84) of the Test Connector (80) are so dimensioned and designed to be compatible with the MMI and FMI, respectively, of the other members of this system; but because of the lack of the ears, hollow skirt and J-shaped slot apertures which exist in the other members, while electrical interconnection is facilitated, no mechanical interlocking can take place.

Before leaving the component descriptions, it is instructive to make the following general observation: the Cap Connector (20) and the Series Connecting Cable (50) enable the user to effect point to point series wiring of circuit elements to which the Cap Connector (20) is attached (electric blasting caps, in this case); and that the Parallel Connecting Cable (60) enables him to make point to point parallel wiring of circuit elements, which themselves may be complete circuits; and, that these members may be used recursively and in combination with one another. This fact is the heart of the invention.

BEST MODE FOR UTILIZING THE INVENTION

In order to illustrate and practice the teaching and structures of this invention, and to demonstrate the advantages its use affords, the same scenario as set forth hereinabove will now be described utilizing the Blasting Connector System (10).

The drilling and loading of holes with explosive charges (100) is as before. After each hole is loaded and primed, each electric blasting cap (28), which is attached to its Cap Connector Assembly (70), may be tested using a galvanometer equipped with a Test Connector (80) by removing the Female Jumper (40) from this Cap Connector Assembly (70), inserting the female end (82) of the Test Connector (80) into the MMI of this Cap Connector (20) and taking a measurement. If the cap (28) is successfully verified, the Female Jumper (40) is replaced, the hole is stemmed and the blaster proceeds to the next hole. If not, the same remedial action as described hereinabove is taken. This process is repeated until all holes have been loaded, primed and stemmed.

No particular accommodation of the fact that this blasting circuit must be wired in parallel-series must be taken at this point, except that the first cap (28) in each series must be identified by the blaster.

Figure 9:
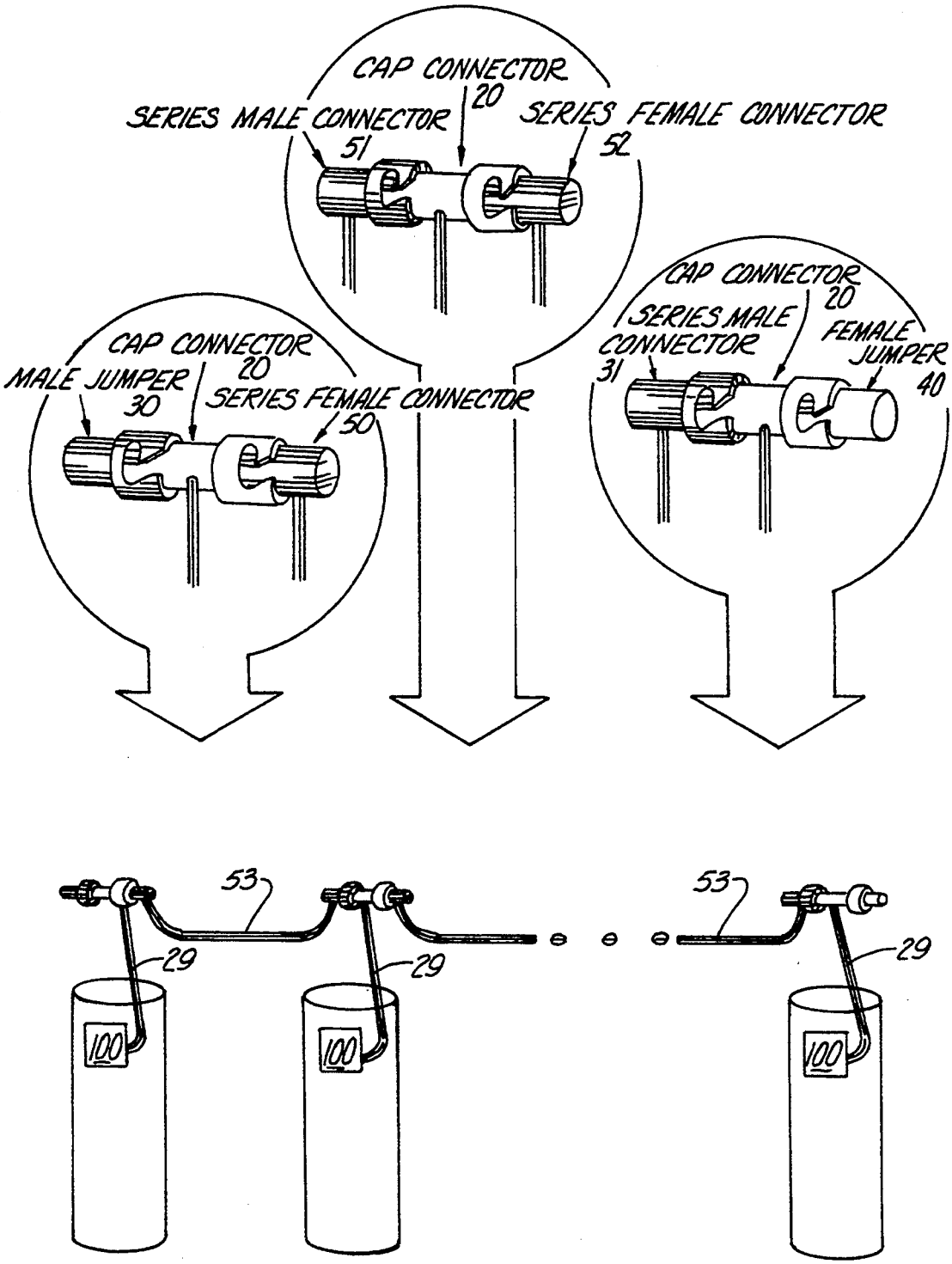
FIG. 9 is a wiring diagram of a blasting circuit for the series wiring of a row of holes.

The blaster then proceeds to hookup each series of caps (28). He does this by starting with the first cap (28) in each series. He simply removes and discards the Female Jumper (40) from the MMI of the Cap Connector (20) of the first cap (28) in the series. The Male Jumper (30) on the first Cap Connector (20) in this, or any other, series is not removed until the parallel wiring is done. This assures that the series is kept shunted. The blaster then selects a Series Connecting Cable (50) long enough to reach the Cap Connector Assembly (70) of the second cap (28) in the series. He inserts this cable's Series Female Connector (52) into the MMI of this first Cap Connector (20) and moves to the Cap Connector Assembly (70) of this second cap (28). He removes and discards the Male Jumper (30) from this Cap Connector Assembly (70) and inserts the Series Male Connector (51) of this selected Series Connecting Cable (50) into the FMI of this second Cap Connector (20). As on the first Cap Connector Assembly (70), he then removes and discards the second Cap Connector Assembly's (70) Female Jumper (40) and selects a Series Connecting Cable (50) long enough to reach the Cap Connector Assembly (70) of the third cap (28) in the series. This process continues until the Cap Connector Assembly (70) of the last cap (28) in the series is wired. The blaster must remove the Female Jumper (40) on the Cap Connector Assembly (70) of the last cap (28) only for the purpose of checking the entire series with his galvanometer, and then he must replace it. Replacing this jumper leaves the entire circuit shunted. Note that the series can be checked at any point in the wiring by plugging the female end (82) of the Test Connector (80) of the galvanometer into the MMI of the Cap Connector (20) of the cap (28) that is presently being wired. This will test the integrity of all caps (28) wired previously in that series. In this manner, faulty wiring can be traced immediately to its source without going back and retesting each point of the circuit. Also, the circuit is always automatically shunted except when a new Series Connecting Cable (50) is being installed or the circuit is being tested. And, finally, there are no exposed, uninsulated wires in the circuit anywhere, at any time. This series wiring process is illustrated in FIG. 9.

Figure 10:
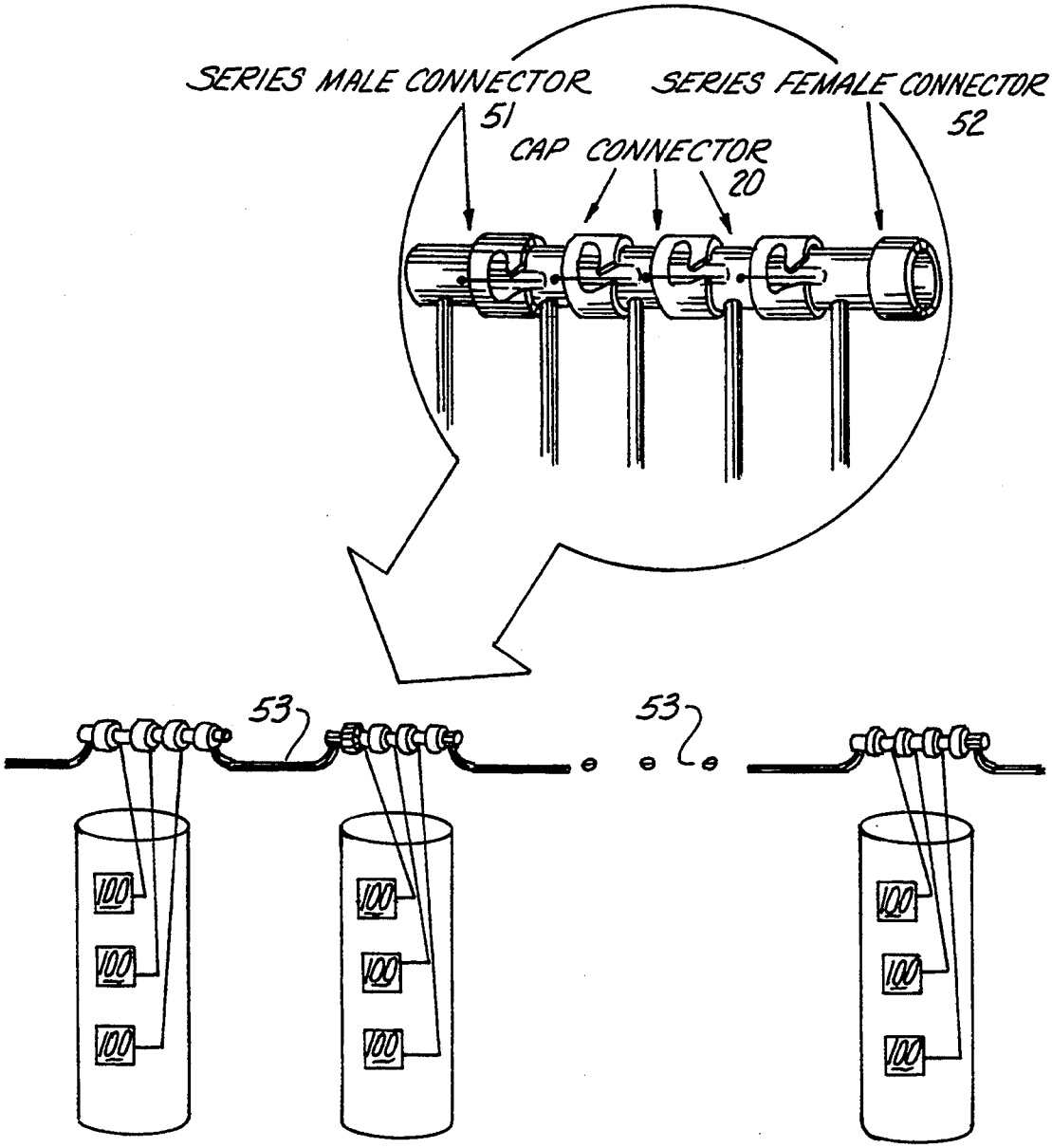
FIG. 10 is a wiring diagram of a blasting circuit employing multiple electric blasting caps in each hole.

Though not featured in this particular scenario, blasting situations frequently arise wherein the use of two or more charges per hole is required. Since, as described hereinabove, Cap Connectors (20) may be stacked, this requirement is easily met utilizing this system. FIG. 10 is an illustration of this capability. Here, three explosive charges (100) per hole are used. The blaster merely removes the Male Jumpers (30) and Female Jumpers (40) from the Cap Connector Assemblies (70) of their respective electric blasting caps (28) and stacks the Cap Connectors (20) together as shown, resulting in the caps (28) being properly wired in series.

Figure 11:
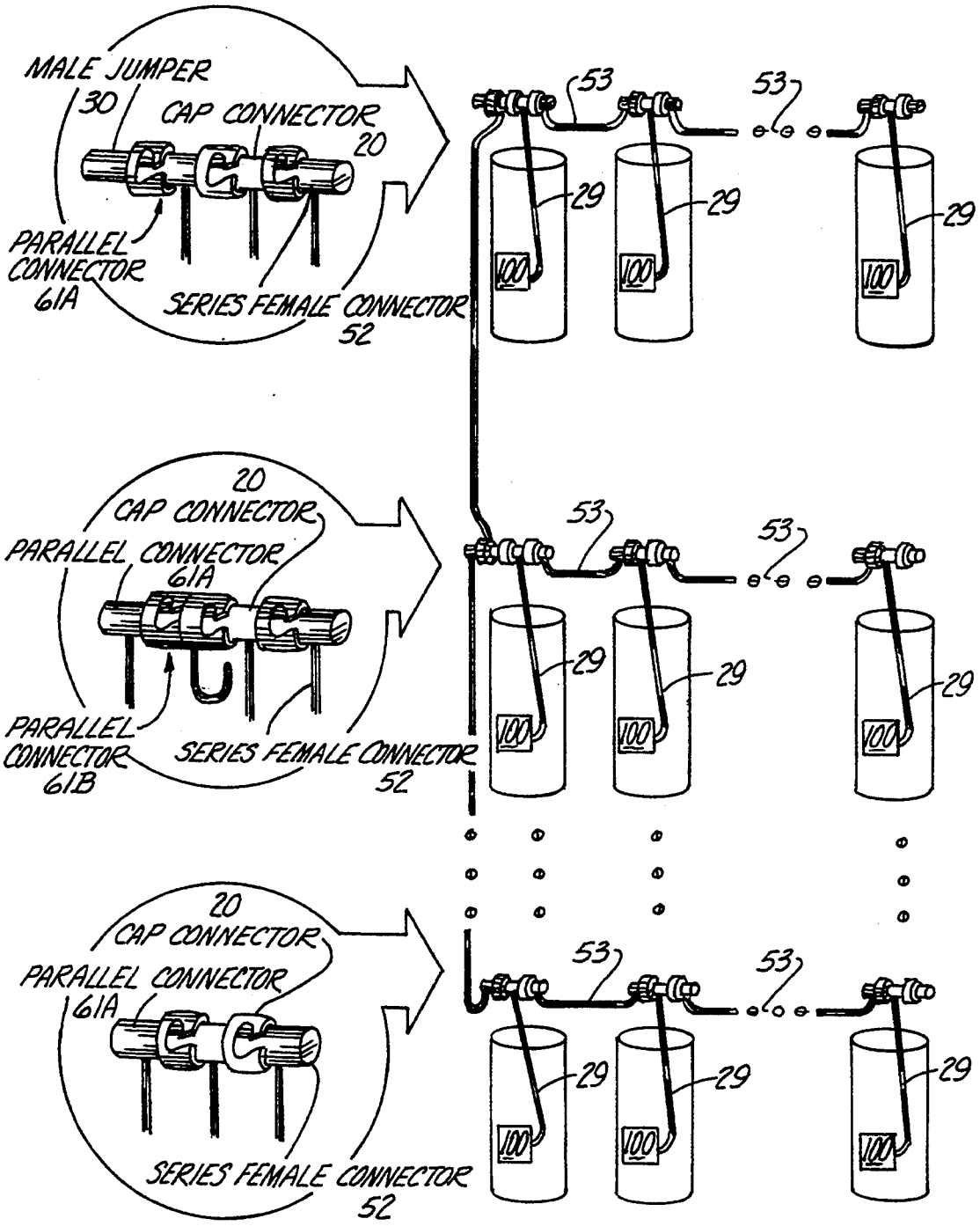
Fig. 11 is a wiring diagram of a blasting circuit for a parallel-series wiring of a plurality of rows; and, FIG. 12 is a wiring diagram of a completed parallel-series blasting circuit.

Once all series have been wired, their connection in parallel can take place using the Parallel Connecting Cables (60). The blaster removes the Male Jumper (30) from the Cap Connector Assembly (70) of the first cap (28) in the first series he wishes to wire and selects a Parallel Connecting Cable (60) long enough to reach the Cap Connector Assembly (70) of the first cap (28) in the second series to be wired. He may, if he desires, test this series by inserting the male end (84) of the Test Connector (80) of his galvanometer into the FMI of this Cap Connector (20). This circuit should already have been tested from the "other end", but this is probably a good practice, and will verify that the series is indeed good. He then inserts the MMI of one of the Parallel Connectors (61A) of this selected Parallel Connecting Cable (60) into the FMI of this first Cap Connector (20) and, in order to keep the circuit shunted, inserts the Male Jumper (30) just removed into the FMI of this Parallel Connector (61A) just installed and moves to the Cap Connector (20) of the first cap (28) in the second series. He removes the Male Jumper (30) from this Cap Connector (20) and this time, and for all subsequent series of caps (28), discards the jumper and performs a test with his galvanometer, if he wishes. He then inserts the MMI of the unconnected Parallel Connector (61 B) of this selected Parallel Connecting Cable (60) into the FMI of this Cap Connector (20). He selects another Parallel Connecting Cable (60) long enough to reach the Cap Connector (20) of the first cap (28) in the third series. He inserts the MMI of one of the Parallel Connector (61A) of this second selected Parallel Connecting Cable (60) into the FMI of the Parallel Connector (61 B) which he has just attached, thus "stacking" the Parallel Connectors (61A, 61B), and moves to the third series. This process is continued until all series are connected. Again, note that the circuit is always shunted and there is never any chance for bare wires to touch the ground or each other. In fact, there is no reason that the entire wiring cannot simply lie on the ground. This parallel wiring process is illustrated in FIG. 11.

The Male Jumper (30) is then removed from the first Parallel Connector (61A) in the first series which, at this point, is the only remaining Male Jumper (30). The entire circuit may be tested with the galvanometer by inserting the male end (84) of the Test Connector (80) into the FMI of this Parallel Connector (61A). The firing line, which is attached to a Series Male Connector (51), and shunted on the other end, is then inserted into this now vacant FMI of this Parallel Connector (61A). A final test with the galvanometer can be done at the firing end. If the circuit is successfully verified, the firing line is attached to the blasting machine (110) and the blast is fired. This wiring process is illustrated in FIG. 12.

As can be seen, this invention not only achieves the stated objective of comprehensiveness, simplicity and safety, but offers many other advantages over conventional techniques in the wiring of blasting circuits involving electric blasting caps: no wire stripping, splicing or making of manual connections is ever needed; caps remain shunted as they are wired; during wiring and firing, no bare wires can contact the ground or each other; the circuit can be easily tested as it is wired; its use reduces the likelihood or wiring errors; it makes circuit wiring much more reliable; it makes inadvertent short or open circuits nearly impossible; it greatly speeds circuit connection; it is much more convenient than manual wiring; it makes final check of wiring much easier; and, it makes electric blasting systems as easy to use as the so called "non-electric initiation" systems widely in use today. The benefits of these advantages are manifest.

Having hereby described the subject matter of the present invention, it should be apparent that many substitutions, modifications and variations of the invention are possible in light of the above teachings. It is therefore to be understood that the invention as taught and described herein is only to be limited to the extent of the breadth and scope of the appended claims.

I claim:

1. A blasting system including a plurality of cooperating structural components that are electrically and mechanically compatible with one another and which are installed in an electrical wiring circuit which extends between the blasting caps in the explosive charges and a blasting machine in a conventional blasting environment, wherein the structural components comprise:

a male jumper which includes a generally cylindrical male jumper body having a lower end provided with a hollow skirt portion having a pair of opposed contoured slots and a pair of electrical pins which project downward from the body and into the skirt portion, a female jumper which includes a generally cylindrical female jumper body having an upper end provided with a pair of sockets and a pair of outwardly projecting opposed ears disposed proximate to said sockets; wherein, the upper end of the female jumper body is dimensioned to be received in the hollow skirt portion of the male jumper body and, wherein the opposed ears of the female, jumper body are dimensioned to be received in the contoured slots in the hollow skirt portion of the male jumper body; and, a cap connector which includes a generally cylindrical cap connector body having an upper end and a lower end; wherein the lower end is provided with a hollow skirt portion having a pair of opposed contoured slots and a pair of electrical pins which project downward from the body and into the skirt portion; the upper end is provided with a pair of sockets and a pair of outwardly projecting opposed ears disposed proximate to said sockets; and wherein one of the pins and one of the sockets of the cap connector body are electrically connected to one another and the other pin and socket of the cap connector are electrically connected to one of said blasting caps.

2. A blasting system as in claim 1, wherein the pair of pins in said male jumper body are electrically connected to one another.

3. A blasting system as in claim 1, wherein the pair of sockets in said female jumper body are electrically connected to one another.

4. A blasting system as in claim 1, further including a parallel connecting cable which comprises:

a duplex wiring cable having opposite ends, wherein each end is provided with a parallel connector which includes a cap connector body, wherein one of the pins and one of the sockets of the cap connector body are electrically connected to one another by a first electrical connection, the other pin and socket of the cap connector body are electrically connected to one another by a second electrical connection, and the first and second electrical connections are independently electrically connected to said duplex wiring cable.

5. A method of forming a series electrical circuit wiring of circuit elements, wherein each circuit element is electrically connected to a cap connector which includes a generally cylindrical cap connector body having an upper end and a lower end; wherein the lower end is provided with a hollow skirt portion having a pair of opposed contoured slots and a pair of electrical pins which project downward from the body and into the skirt portion, the upper end is provided with a pair of sockets and a pair of outwardly projecting opposed ears disposed proximate to said sockets; and, wherein one of the pins and one of the sockets of the cap connector body are electrically connected to one another and the other pin and socket of the cap connector body are electrically connected to one of said circuit elements, comprising the steps:

a) operatively engaging the upper and lower end of each cap connector body, respectively, to the opposite ends of a series connecting cable, wherein each series connecting cable comprises:

a duplex wiring cable having opposite ends, wherein one end of the duplex wiring cable is provided with a series male connector which includes a male jumper body having a lower end provided with a hollow skirt portion having a pair of opposed contoured slots and a pair of electrical pins which project downward from the body and into the skirt portion, wherein the electrical pins of the male jumper body are electrically connected to said one end of the duplex wiring cable, and wherein the other end of the duplex wiring cable is provided with a series female connector which includes a female jumper body, having an upper end provided with a pair of sockets and a pair of outwardly projecting opposed ears disposed proximate to said sockets; wherein the upper end of the female jumper body is dimensioned to be received in the hollow skirt portion of the male jumper body and, wherein the opposed ears of the female jumper body are dimensioned to be received in the contoured slots in the hollow skirt portion of the male jumper body, wherein the electrical sockets of the female jumper body are electrically connected to said other end of the duplex wiring cable.

6. A method of connecting the series electrical circuit wiring of circuit elements as defined in the method of claim 5 into a parallel-series electrical circuit wiring of circuit elements by employing a plurality of parallel connecting cables, wherein each parallel connecting cable comprises: a duplex wiring cable having opposite ends and each end is provided with a parallel connector which includes a cap connector body, wherein one of the pins and one of the sockets of the cap connector body are electrically connected to one another by a first electrical connection, the other pin and socket of the cap connector body are electrically connected to one another by a second electrical connection, and the first and second electrical connections are independently electrically connected to said duplex wiring cable, comprising the steps of:

b) inserting the male mating interface of one of the parallel connectors on one end of the duplex wiring cable of a first parallel connecting cable into the female mating interface of the cap connector on a first series electrical wiring circuit;

c) inserting the male mating interface of the other of the parallel connectors on the other end of the duplex wiring cable of said first parallel connecting cable into the female mating interface of the cap connector on a second series electrical wiring circuit;

d) inserting the male mating interface of one of the parallel connectors on one end of the duplex wiring cable of a second parallel connecting cable into the female mating interface of said other of the parallel connectors on the other end of the duplex wiring cable of said first parallel connecting cable; and, e) inserting the male mating interface of the other of the parallel connectors on the other end of the duplex wiring cable of said second parallel connecting cable into the female mating interface of the cap connector on a third series electrical wiring circuit.

7. A blasting system including a plurality of cooperating structural components that are electrically and mechanically compatible with one another and which are installed in an electrical wiring circuit which extends between the blasting caps in the explosive charges and a blasting machine in a conventional blasting environment, wherein the structural components comprise:

a male jumper which includes a generally cylindrical male jumper body having a lower end provided with a hollow skirt portion having a pair of opposed contoured slots and a pair of electrical pins which project downward from the body and into the skirt portion;

a female jumper which includes a generally cylindrical female jumper body having an upper end provided with a pair of sockets and a pair of outwardly projecting opposed ears disposed proximate to said sockets; wherein, the upper end of the female jumper body is dimensioned to be received in the hollow skirt portion of the male jumper body and, wherein the opposed ears of the female jumper body are dimensioned to be received in the contoured slots in the hollow skirt portion of the male jumper body;

a cap connector which includes a generally cylindrical cap connector body having an upper end and a lower end; wherein the lower end is provided with a hollow skirt portion having a pair of opposed contoured slots and a pair of electrical pins which project downward from the body and into the skirt portion; and, wherein the upper end is provided with a pair of sockets and a pair of outwardly projecting opposed ears disposed proximate to said sockets; and, a test connector which comprises: an elongated generally cylindrical connector body having an upper end provided with a pair of female sockets and a lower end provided with a pair of downward depending electrical pins.

8. A blasting system as in claim 7, wherein each one of the female sockets in the test connector body are electrically connected to a respective one of the electrical pins in the test connector body.

9. A blasting system as in claim 8, wherein each electrically connected pin and socket in the test connector body are adapted to be electrically connected to a galvanometer.

10. A blasting system including a plurality of cooperating structural components that are electrically and mechanically compatible with one another and which are installed in an electrical wiring circuit which extends between the blasting caps in the explosive charges and a blasting machine in a conventional blasting environment, wherein the structural components comprise:

a male jumper which includes a generally cylindrical male jumper body having a lower end provided with a hollow skirt portion having a pair of opposed contoured slots and a pair of electrical pins which project downward from the body and into the skirt portion.

a female jumper which includes a generally cylindrical female jumper body having an upper end provided with a pair of sockets and a pair of outwardly projecting opposed ears disposed proximate to said sockets; wherein, the upper end of the female jumper body is dimensioned to be received in the hollow skirt portion of the male jumper body and, wherein the opposed ears of the female jumper body are dimensioned to be received in the contoured slots in the hollow skirt portion of the male jumper body;

a cap connector which includes a generally cylindrical cap connector body having an upper end and a lower end; wherein the lower end is provided with a hollow skirt portion having a pair of opposed contoured slots and a pair of electrical pins which project downward from the body and into the skirt portion; and, wherein the upper end is provided with a pair of sockets and a pair of outwardly projecting opposed ears disposed proximate to said sockets; and, a series connecting cable which comprises: a duplex wiring cable having opposite ends; wherein, one end of the duplex wiring cable is provided with a series male connector which includes a male jumper body, wherein the electrical pins of the male jumper body are electrically connected to said one end of the duplex wiring cable, and wherein the other end of the duplex wiring cable is provided with a series female connector which includes a female jumper body, wherein the electrical sockets of the female jumper body are electrically connected to said other end of the duplex wiring cable.

* * * * *